US009328926B2

(12) United States Patent
Penz et al.

(10) Patent No.: US 9,328,926 B2
(45) Date of Patent: May 3, 2016

(54) SEGMENTED COMBUSTION CHAMBER HEAD

(75) Inventors: Stefan Penz, Werneuchen (DE); Miklos Gerendas, Am Mellensee (DE); Sermed Sadig, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1068 days.

(21) Appl. No.: 13/426,070

(22) Filed: Mar. 21, 2012

(65) Prior Publication Data

US 2012/0240583 A1 Sep. 27, 2012

(30) Foreign Application Priority Data

Mar. 22, 2011 (DE) ..... 10 2011 014 670

(51) Int. Cl.

| | |
|---|---|
| ***F23R 3/60*** | (2006.01) |
| ***F23R 3/00*** | (2006.01) |
| ***F23R 3/10*** | (2006.01) |
| ***F23R 3/28*** | (2006.01) |

(52) U.S. Cl.

CPC . *F23R 3/60* (2013.01); *F23R 3/002* (2013.01); *F23R 3/10* (2013.01); *F23R 3/283* (2013.01); *F23R 2900/00012* (2013.01); *F23R 2900/00014* (2013.01)

(58) Field of Classification Search

CPC ..... F23R 3/002; F23R 3/10; F23R 3/60; F23R 2900/00014; F23R 2900/00012

See application file for complete search history.

(56) References Cited

U.S. PATENT DOCUMENTS

| | | | |
|---|---|---|---|
| 5,524,438 | A | 6/1996 | Johnson et al. |
| 5,623,827 | A | 4/1997 | Monty |
| 5,956,955 | A | 9/1999 | Schmid |
| 6,164,074 | A | 12/2000 | Madden et al. |
| 6,679,063 | B2 | 1/2004 | Ebel |
| 7,478,534 | B2 | 1/2009 | Guezengar et al. |
| 7,770,398 | B2 | 8/2010 | DeSousa et al. |
| 7,775,766 | B2 | 8/2010 | Meier et al. |
| 7,861,531 | B2 | 1/2011 | Bunel et al. |

(Continued)

FOREIGN PATENT DOCUMENTS

| | | |
|---|---|---|
| DE | 4427222 | 2/1996 |
| DE | 10048864 | 4/2002 |

(Continued)

OTHER PUBLICATIONS

European Search Report dated Oct. 29, 2014 for counterpart European Patent Application No. 12001992.2.

(Continued)

*Primary Examiner* — Phutthiwat Wongwian
*Assistant Examiner* — Stefan Ibroni
(74) *Attorney, Agent, or Firm* — Timothy J. Klima; Shuttleworth & Ingersoll, PLC

(57) ABSTRACT

A combustion chamber head for a gas turbine, with the gas turbine having a substantially annular outer combustion chamber wall, at least one substantially annular inner combustion chamber wall, and several burners 106 distributed around a circumference of the gas turbine. Several segment-like head segments are arranged over the circumference in equal number to the number of burners and extend in the radial direction between the inner combustion chamber wall and the outer combustion chamber wall and in the circumferential direction between radial planes formed by the burner axes.

17 Claims, 11 Drawing Sheets

(56) References Cited

U.S. PATENT DOCUMENTS

| | | | | |
|---|---|---|---|---|
| 8,096,134 | B2 | 1/2012 | Hernandez et al. | |
| 2009/0044538 | A1* | 2/2009 | Pelletier et al. | 60/740 |
| 2010/0089068 | A1 | 4/2010 | Ellis et al. | |
| 2011/0000216 | A1* | 1/2011 | Imamura et al. | 60/748 |
| 2011/0005233 | A1 | 1/2011 | Sadig et al. | |

FOREIGN PATENT DOCUMENTS

| | | |
|---|---|---|
| DE | 10360164 | 7/2005 |
| DE | 102009032277 | 1/2011 |
| EP | 1818615 | 8/2007 |
| EP | 2012062 | 1/2009 |
| FR | 2897417 | 8/2007 |
| FR | 2914399 | 10/2008 |
| FR | 2935465 | 3/2010 |
| GB | 2107448 | 4/1983 |
| GB | 2147405 | 5/1985 |
| JP | 2008008611 | 1/2008 |

OTHER PUBLICATIONS

German Search Report dated Nov. 10, 2011 from counterpart application.

* cited by examiner

SEGMENTED COMBUSTION CHAMBER HEAD

This application claims priority to German Patent Application 10 2011 014 670.9 filed Mar. 22, 2011, the entirety of which is incorporated by reference herein.

This invention relates to a combustion chamber head In particular, the invention relates to a combustion chamber head of a gas turbine, the gas turbine having a substantially annular outer combustion chamber wall and with at least one substantially annular inner combustion chamber wall, and with several burners distributed over the circumference.

Annular combustion chambers according to the state of the art include a combustion chamber head which is radially delimited by the inner and outer combustion chamber walls.

A known design of the combustion chamber head includes a baseplate connected to the inner and outer combustion chamber walls.

A heat-shield is attached to this baseplate on the inside of the combustion chamber. The heat-shields are in each case positioned around the burner.

A sealing element is used for moveable mounting of the injection nozzle. This element is positioned by means of holding devices or between the heat-shield and the baseplate. A dome-like cover-plate is attached on the outside of the combustion chamber.

The following describes designs known from the state of the art in conjunction with FIGS. 1 to 4.

Figure 1:
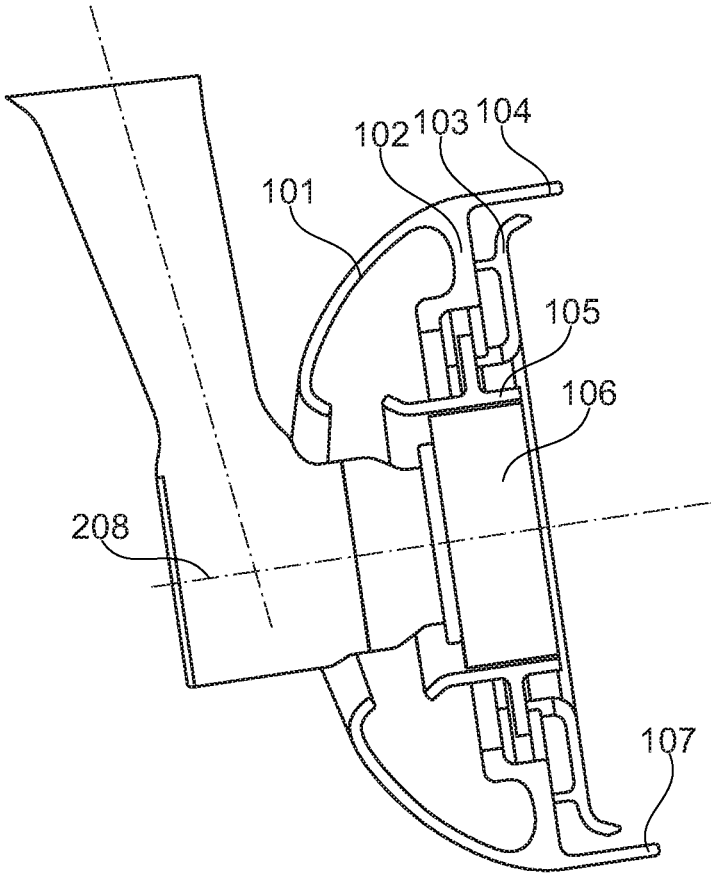
Fig. 1 (Prior Art)
Figure 2:
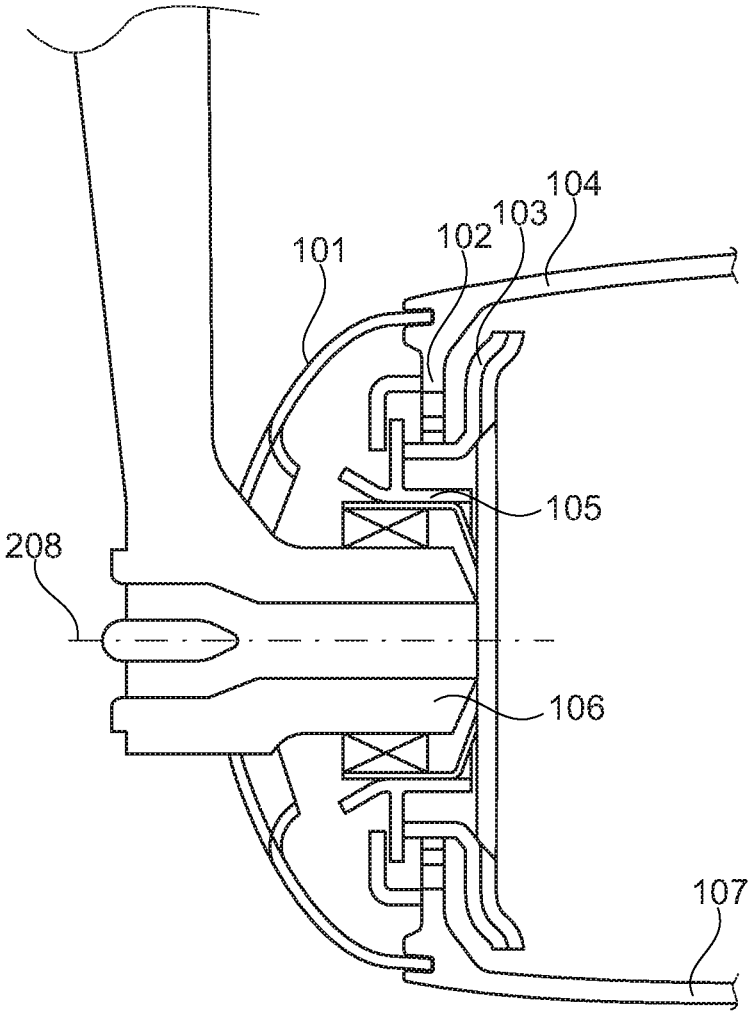
Fig. 2 (Prior Art)
Figure 3:
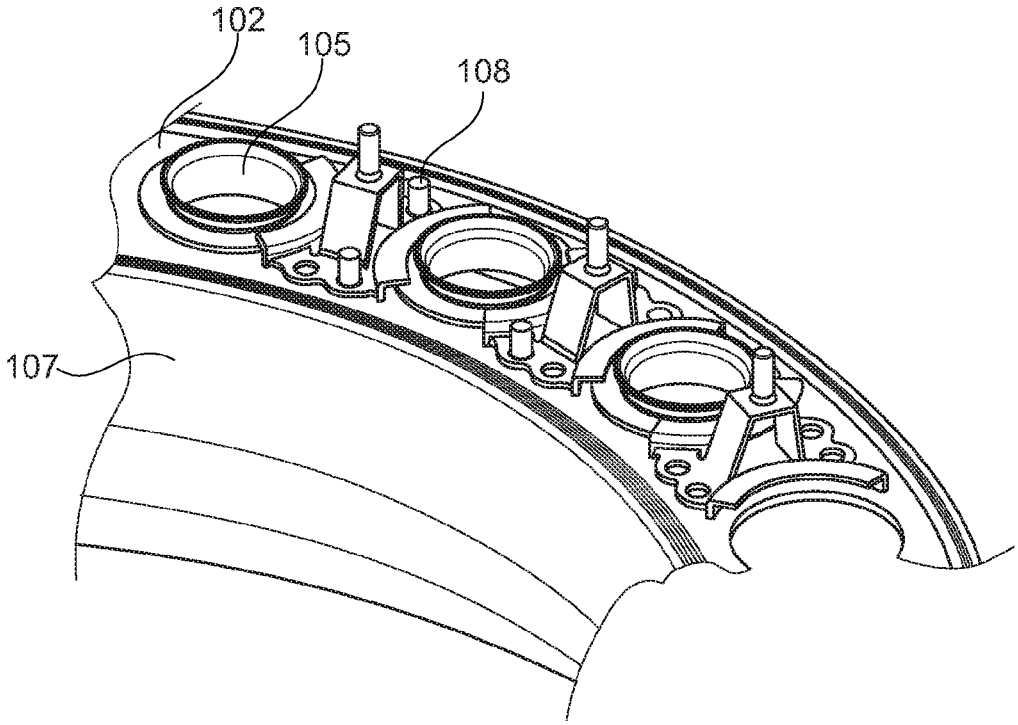
Fig. 3 (Prior Art)
Figure 4:
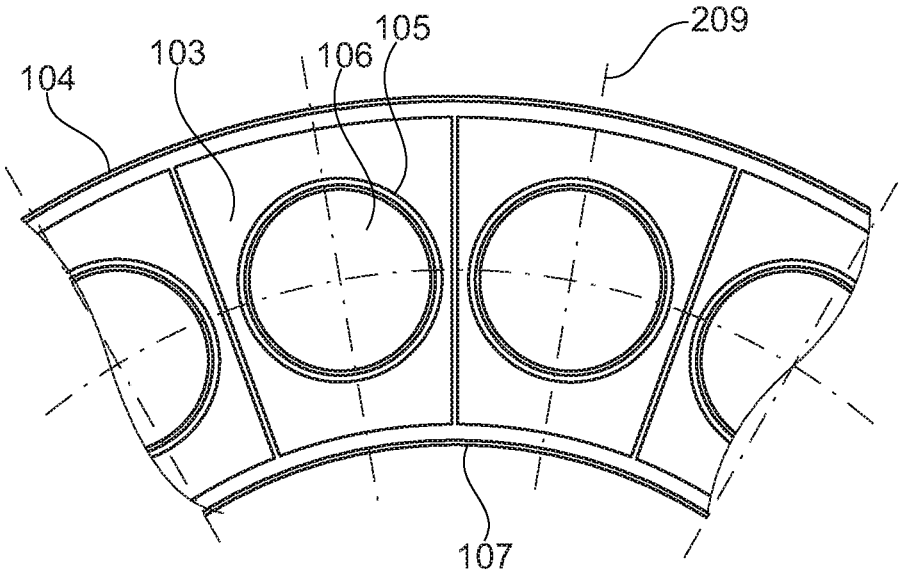
Fig. 4 (Prior Art)

The design of a combustion chamber known from the state of the art, in particular of the combustion chamber head, is described in DE 44 27 222 A1 (FIGS. 1 and 4). The combustion chamber head includes a dome-like cover-plate 101, a baseplate 102 extending between the inner and outer combustion chamber walls 107 and 104, a plurality of heat-shields 103, a plurality of burners 106 and one sealing element 105 per burner. These components are connected to one another in a known manner, by for example welding, bolting or clamping. The heat-shields 103 are generally designed as segments, positioned around the burner and connected to the front plate. DE 100 48 864 A1 (FIGS. 2 and 3) also describes the design of a combustion chamber head. The dome-like cover-plate 101 is here designed as a separate part and fastened mechanically to the combustion chamber head. The holding elements 108 act here simultaneously as holders for the dome-like cover-plate 101 and as holders for the sealing elements 105.

In all designs, the structural parts are designed as solid rings.

These known designs consist of many individual components that have to be assembled. In some cases, assembly requires additional openings in the dome-like cover-plate or the latter is fitted in an additional operation. The known designs do not form any closed-off volume that can be used for absorption of acoustic vibrations.

The present invention, in a broad aspect, provides a combustion chamber head of the type specified at the beginning above which, while being simply designed and easily and cost-effectively producible and mountable, avoids the disadvantages of the state of the art.

It is thus provided in accordance with the invention that several segment-like head segments are arranged over the circumference preferably in equal number to the number of burners and extend in the radial direction between the inner combustion chamber wall and the outer combustion chamber wall and in the circumferential direction between radial planes formed by central burner axes.

The invention thus describes a design solution for a segmented combustion chamber head, in particular for an annular combustion chamber of a gas turbine, in which a simple-to-manufacture and very simple-to-assemble overall design is provided. The assembled head segments form in accordance with the invention a complete combustion chamber head, including the function of a cover-plate and a base-plate as well as the function of a heat-shield. Furthermore, the assembled head segments form a dampening volume which is particularly suitable for sound absorption. Assembly is simplified due to the low number of individual components. Maintenance and checking can also be done more easily and at lower expense.

Since the individual head segments adjoin with their separation planes (circumferential limiting edges) in the central burner axis or in a radial plane defined by the central burner axis and the engine axis, an advantageous design also results in terms of the thermal expansions and the mechanical stresses they cause. The intermediate areas between adjacent head segments are preferably each sealed by at least one sealing element. This can preferably be designed annularly and enclose the burner. It is particularly advantageous here when the sealing element is guided in grooves of the burner and/or of the head element and hence held and positioned. Remaining radially outer or radially inner intermediate areas can be sealed in a simple manner by additional sealing elements. It is for example also possible here to provide a fin and a deformable element. It is furthermore possible to provide labyrinth seal-like elements for sealing purposes.

The solution in accordance with the invention reduces the complexity of the combustion chamber head in that the combustion chamber head segments combine various functions of the individual parts of the conventional combustion chamber head. Furthermore, this design offers the possibility of providing the volume necessary for absorption of acoustic vibrations. The functioning of such absorbers is described in DE 10 2009 032 277 A1. The closed-off volume necessary to do so is provided inside a head segment.

Figure 10:
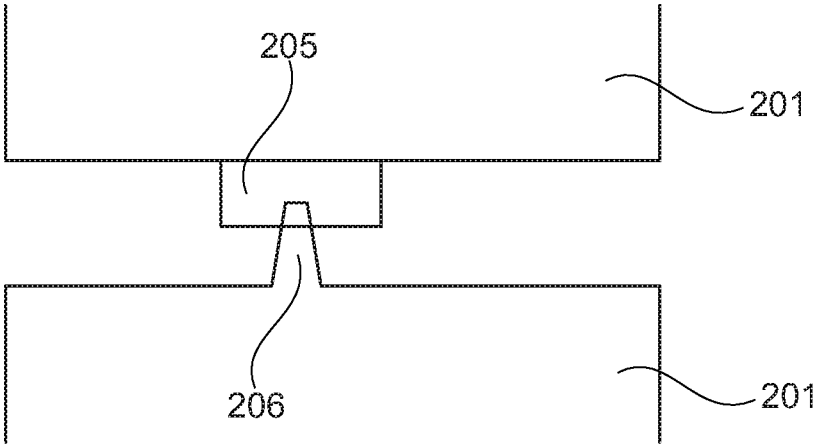
Figure 11:
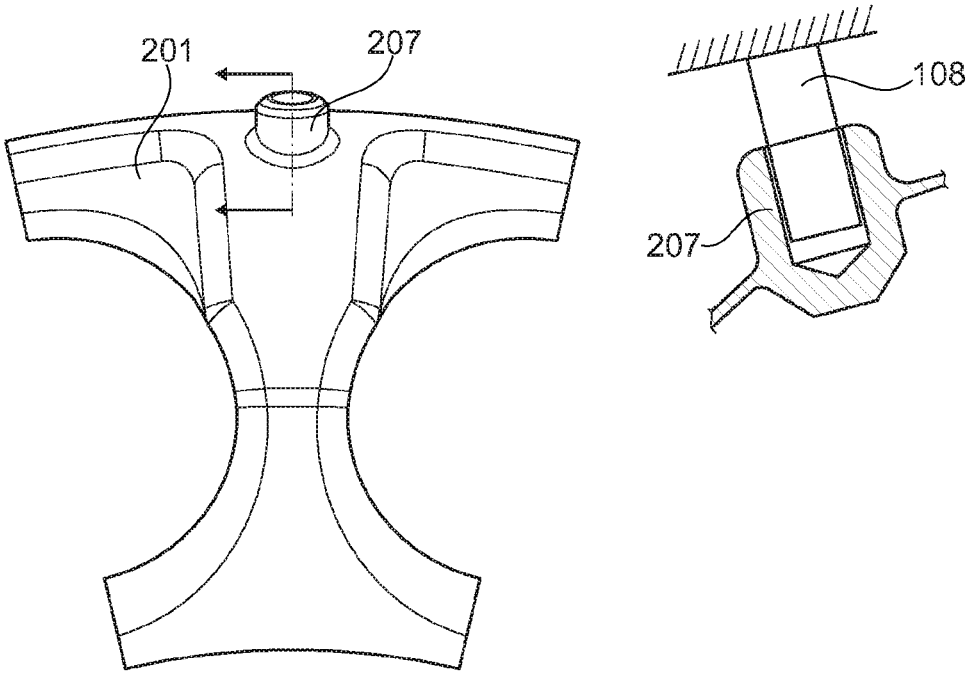
Figure 12:
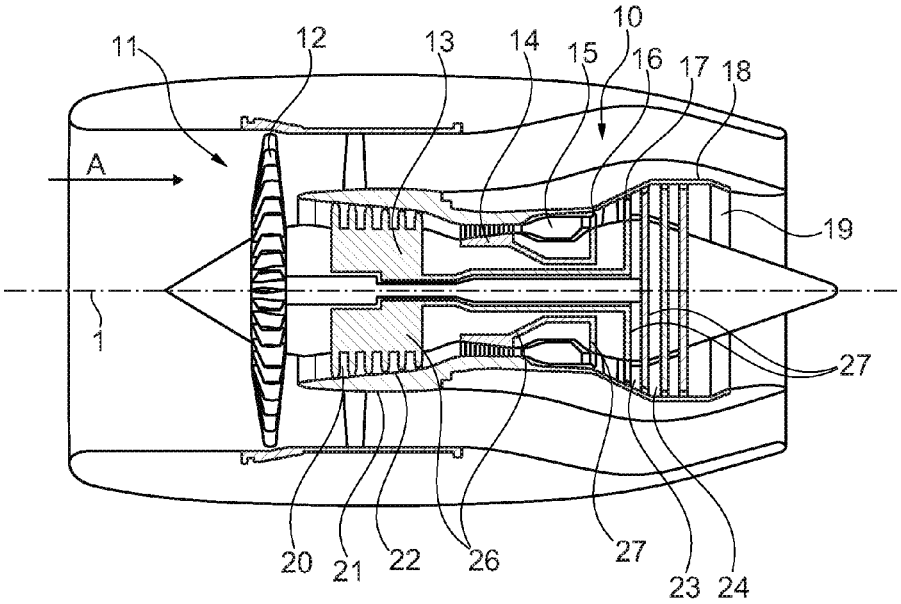
Figure 13:
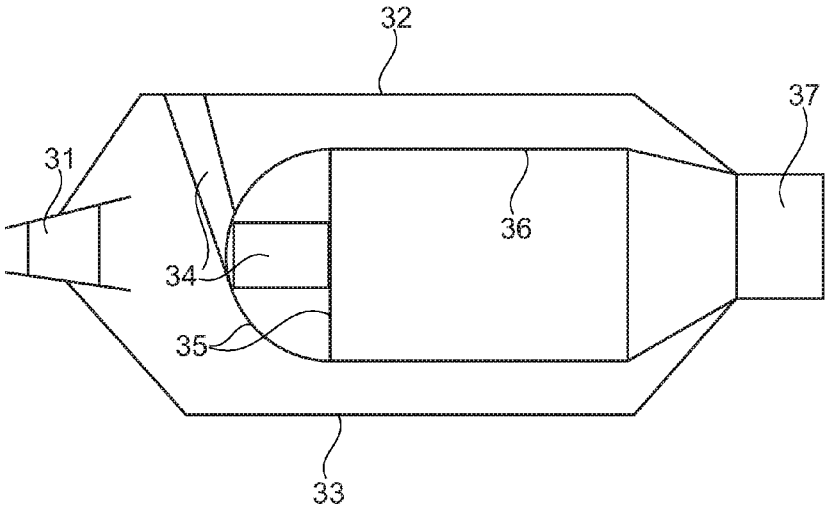

The present invention is described in the following in light of the accompanying drawings, showing preferred embodiments. In the drawings, FIG. 1 (Prior Art) shows a simplified partial sectional view in the axial direction of a combustion chamber head known from the state of the art, FIG. 2 (Prior Art) shows a view of a further combustion chamber head known from the state of the art by analogy with FIG. 1, FIG. 3 (Prior Art) shows a perspective partial view of the design shown in FIG. 2 in accordance with the state of the art, FIG. 4 (Prior Art) shows a detailed representation of the heat-shields in accordance with the state of the art by analogy with the design shown in FIG. 1, FIG. 5 shows a partial view of a first exemplary embodiment of the inventive design of a head element with sealing elements, FIG. 6 shows views of the inventive solution shown in FIG. 5 in the assembled state in a flow direction (upper half of FIG. 6) and against the flow direction (lower half of FIG. 6), FIG. 7 shows a partial sectional view in the axial direction by analogy with the representations of FIGS. 1 and 2 of the exemplary embodiment shown in FIGS. 5 and 6, FIG. 8 shows simplified representations of a further exemplary embodiment of a sealing element with extensions as well as assembly options, FIG. 9 shows a simplified representation of a further exemplary embodiment of a seal that can be used in accordance with the present invention, FIG. 10 shows a simplified representation of a further exemplary embodiment of a seal that can be used in accordance with the present invention, FIG. 11 shows simplified representations in partial views of a further exemplary embodiment of the invention with bushing and locating pin, FIG. 12 shows a schematic representation of a gas-turbine engine in accordance with the present invention, and FIG. 13 shows a schematic partial sectional view in the axial direction of a gas-turbine combustion chamber in accordance with the present invention.

Figure 5:
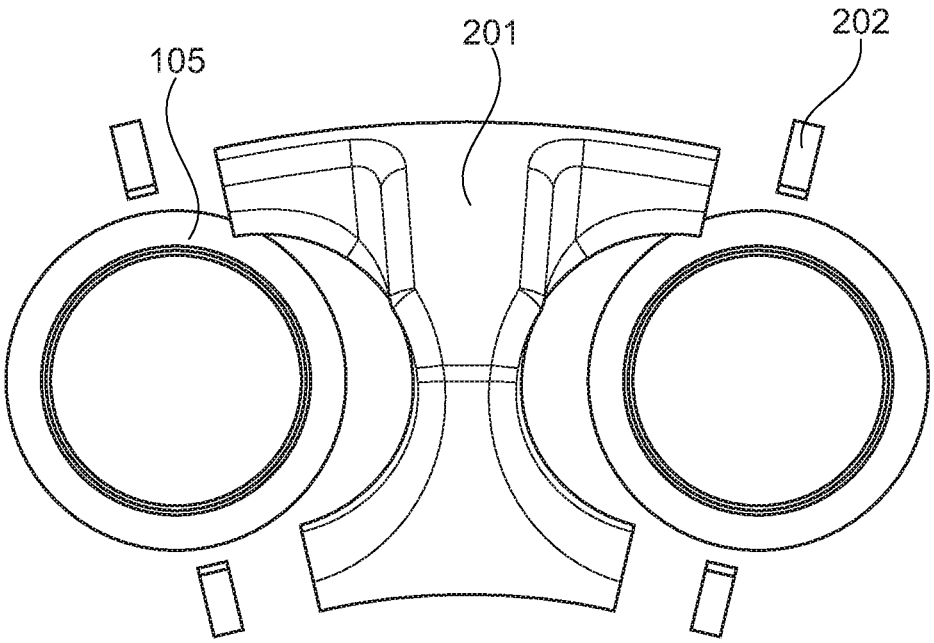
Figure 6:
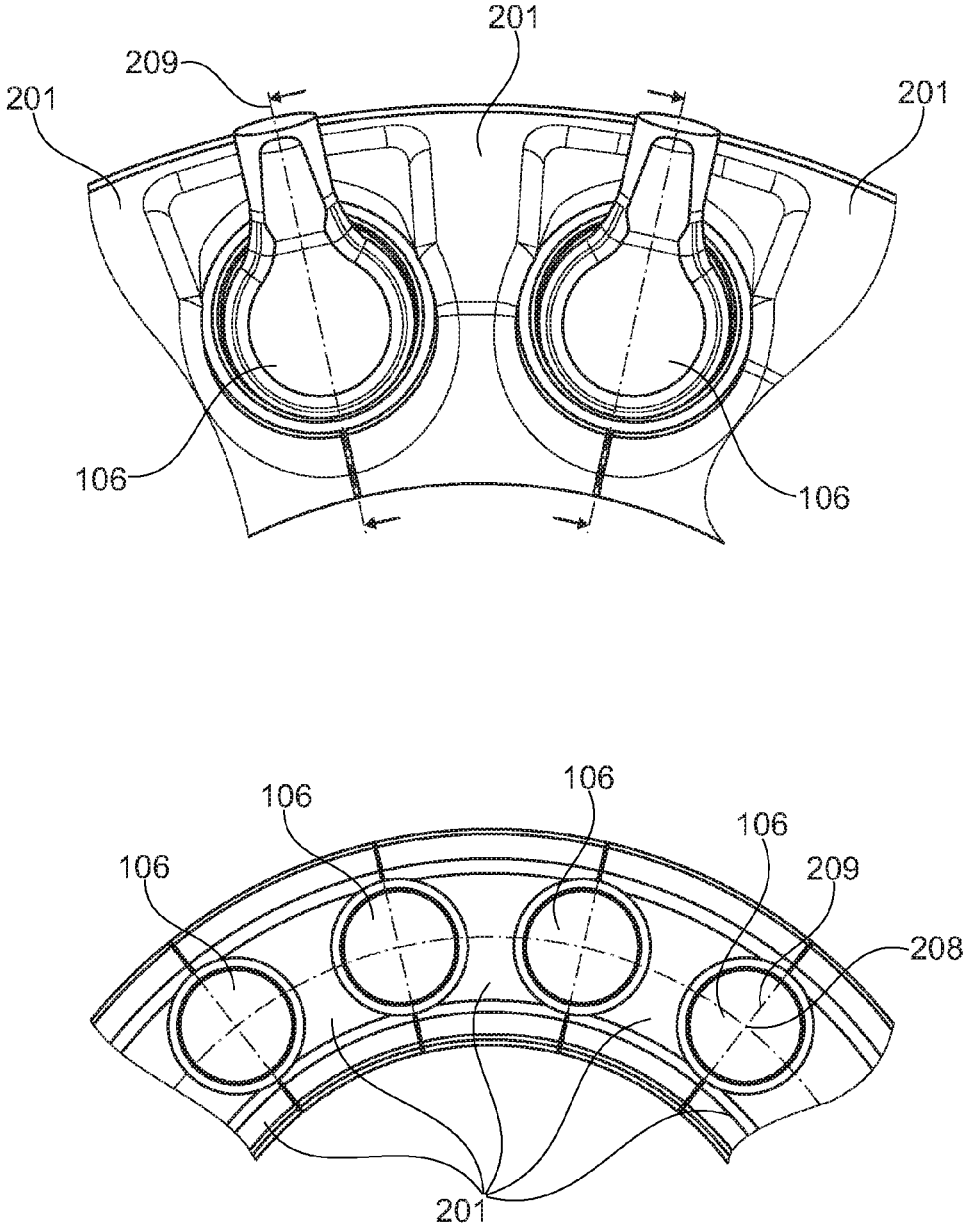
Figure 7:
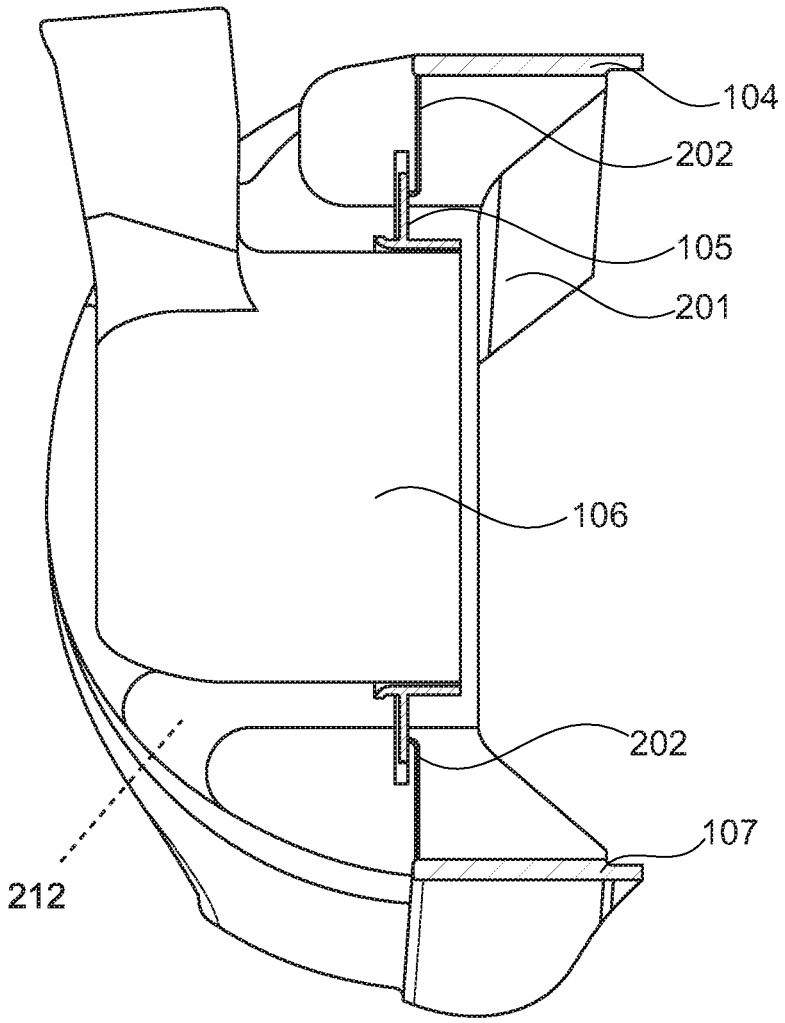

FIGS. 5, 6 and 7 show a combustion chamber head not constructed from one annular head element, but instead in accordance with the invention from a plurality of head segments 201 preferably equalling the number of burners 106. These head segments 201 extend in a radial direction between the inner and outer combustion chamber walls 107 and 104 and are mechanically connected there in a known manner, e.g. using bolts. In the circumferential direction, the head segments 201 each extend in an area between two burners 106. The circumferential division thus coincides with the burner axis 208. The moveable sealing elements 105, which seal the area around the burner 106 against uncontrolled ingress of compressor air into the combustion chamber 15 and at the same time permit a relative movement between the burner 106 and the combustion chamber head 35, are mounted in slots integrated in the head segments 201. This reduces the assembly effort and also the number of small parts. At the same time, a large area of the gap between two segments is sealed. In the area between the sealing element 105 and the inner or outer combustion chamber wall 107 or 104, respectively, the remaining gap is sealed using a sealing strip 202 against uncontrolled entry of air. In an assembled state, the head segments 201 form a dampening volume 212. See FIG. 7.

Figure 8:
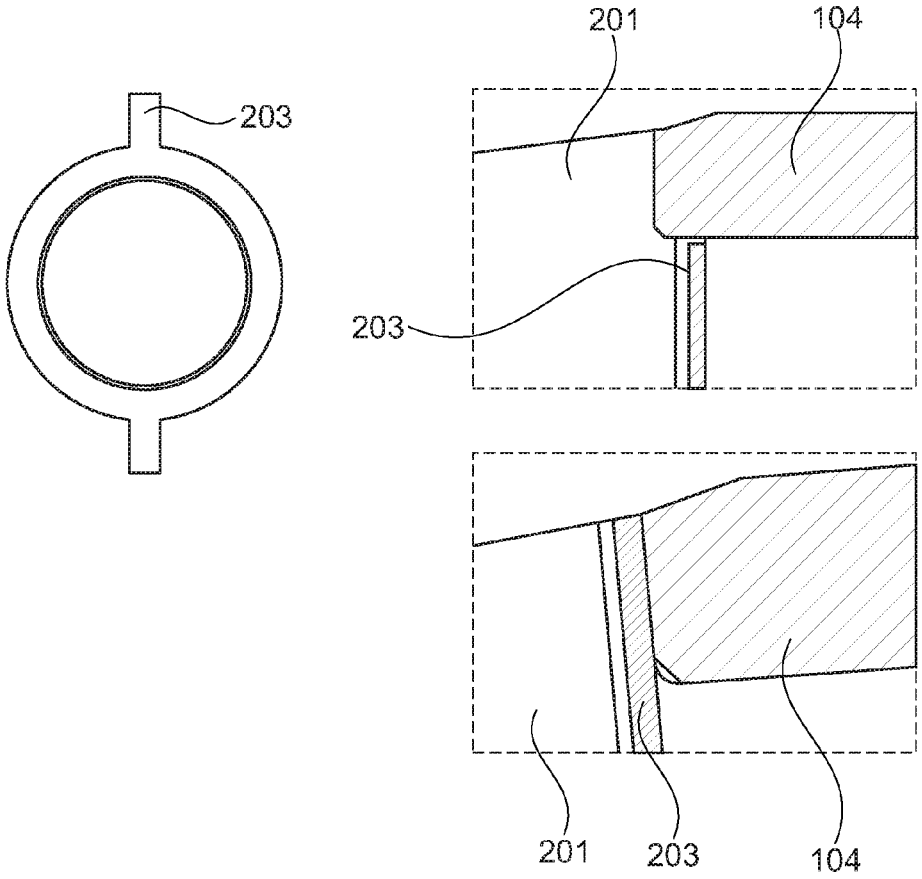

Alternatively, the gap can also be sealed using a specially shaped sealing element with extensions 203 (FIG. 8).

Figure 9:
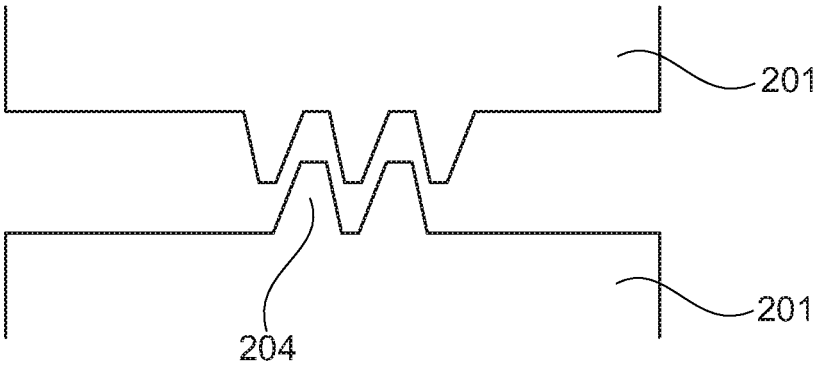

Alternatively, the leakage airflow can also be checked using a labyrinth 204 provided on the side faces of the head segments 201 (FIG. 9).

A further possibility for sealing is the formation of mating surfaces on the side walls of the head segments 201.

A further possibility for sealing is the formation of one or more fins 206 on one side of the head segment and the application of an easily deformable material 205 on the opposite side of the head segment (FIG. 10). This material can for example be a metal foam, as described in DE 10 360 164 A1.

The combustion chamber head is assembled by fitting together the sealing elements 105, the sealing strips 202 and the head segments 201 into a complete ring. Then the inner and outer combustion chamber walls 107 and 104 are connected to the head segments 201, so that the sealing elements 105 and sealing strips 202 are held moveably in position.

In the case of a front combustion chamber suspension with a locating pin 108, as described in GB 2 147 405 A, the bushing 207 for holding the pin can be integrated into individual or into all head segments 201 (FIG. 11).

FIG. 12 shows a schematic representation of a gas-turbine engine in accordance with the present invention.

The gas-turbine engine 10 according to FIG. 12 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, combustion chambers 15, a high-pressure turbine 16, an intermediate-pressure turbine 17 and a low-pressure turbine 18 plus an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disc 26 linked to hubs 27 of the high-pressure turbine 16 or of the intermediate-pressure turbine 17.

The turbine sections 16, 17, 18 have similar stages, including an arrangement of fixed guide vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disc 26 and the blades 22 arranged thereon, as well as the turbine rotor hub 27 and the turbine rotor blades 24 arranged thereon rotate about the engine axis 1 during operation.

FIG. 13 shows in schematic form compressor outlet blades 31 through which compressor air is introduced into a combustion chamber casing. The latter includes a combustion chamber outer casing 32 and a combustion chamber inner casing 33. Furthermore, a burner is provided with an arm and head (reference numeral 34). The reference numeral 35 shows in schematic form a combustion chamber head adjoined by a combustion chamber wall 36. The reference numeral 37 shows turbine inlet blades in schematic form.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Combustion chambers
16 High-pressure turbine
17 Intermediate-pressure turbine
18 Low-pressure turbine
19 Exhaust nozzle
20 Guide vanes
21 Engine casing
22 Compressor rotor blades
23 Guide vanes
24 Turbine blades
25 Compressor drum or disc
27 Turbine rotor hub
31 Compressor outlet blades
32 Combustion chamber outer casing
33 Combustion chamber inner casing
34 Burner with arm and head
35 Combustion chamber head
36 Combustion chamber wall
37 Turbine inlet blades
101 Dome-like cover-plate
102 Baseplate
103 Heat-shield
104 Outer combustion chamber wall
105 Sealing element
106 Burner
107 Inner combustion chamber wall

108 Holding element/locating pin
201 Head segment
202 Sealing strip
203 Sealing element with extension
204 Labyrinth
205 Deformable material/element
206 Fin
207 Integrated bushing
208 Central burner axis
209 Radial plane

What is claimed is:

1. A combustion chamber head for a gas turbine:

wherein the gas turbine includes an axis; a substantially annular outer combustion chamber wall; at least one substantially annular inner combustion chamber wall: and a plurality of burners distributed around a circumference of the gas turbine;

the combustion chamber head comprising a plurality of head segments arranged around the circumference in equal number to a number of the burners and extending in a radial direction between the inner combustion chamber wall and the outer combustion chamber wall and also extending in a circumferential direction between two adjacent ones of the burners;

each head segment having a radially outer edge, a radially inner edge and opposite first and second outer side edges each extending between the radially inner edge and the radially outer edge, with the first outer side edge positioned adjacent a first one of the two adjacent ones of the burners and the second outer side edges positioned adjacent a second one of the two adjacent ones of the burners;

the first outer side edge including a first portion extending between the inner combustion chamber wall and the first one of the two adjacent ones of the burners, a second portion notched toward a center of the head segment to fit around a portion of an outer periphery of the first one of the two adjacent ones of the burners and a third portion extending between the first one of the two adjacent ones of the burners and the outer combustion chamber wall;

the second outer side edge including a fourth portion extending between the inner combustion chamber wall and the second one of the two adjacent ones of the burners, a fifth portion notched toward a center of the head segment to fit around a portion of an outer periphery of the second one of the two adjacent ones of the burners and a sixth the outer combustion chamber wall.

2. The combustion chamber head of claim 1, and further comprising at least one sealing element positioned between the burners and the head segments.

3. The combustion chamber head of claim 2, wherein the sealing element is substantially annular.

4. The combustion chamber head of claim 3, wherein the sealing element is at least partly positioned in at least one of grooves of the burner or of the head element.

5. The combustion chamber head of claim 4, wherein the sealing element includes at least one fin and a deformable element that can be interactively engaged with the fin.

6. The combustion chamber head of claim 4, wherein the sealing element includes at least one labyrinth seal.

7. The combustion chamber head of claim 4, wherein a plurality of the head segments each include at least one bushing for interaction with at least one holding element.

8. The combustion chamber head of claim 4, wherein the head segments in an assembled state form at least one dampening volume.

9. The combustion chamber head of claim 8, wherein the head segments in the assembled state form a combustion chamber head with a baseplate and a heat-shield.

10. The combustion chamber head of claim 9, wherein the head segments in the assembled state are, tightly or with defined openings, connected to the outer combustion chamber wall and to the inner combustion chamber wall.

11. The combustion chamber head of claim 2, wherein the sealing element is at least partly positioned in at least one of grooves of the burner or of the head element.

12. The combustion chamber head of claim 2, wherein the sealing element includes at least one fin and a deformable element that can be interactively engaged with the fin.

13. The combustion chamber head of claim 2, wherein the sealing element includes at least one labyrinth seal.

14. The combustion chamber head of claim 1, wherein a plurality of the head segments each include at least one bushing for interaction with at least one holding element.

15. The combustion chamber head of claim 1, wherein the head segments in an assembled state form at least one dampening volume.

16. The combustion chamber head of claim 1, wherein the head segments in the assembled state form a combustion chamber head with a baseplate and a heat-shield.

17. The combustion chamber head of claim 1, wherein the head segments in the assembled state are, tightly or with defined openings, connected to the outer combustion chamber wall and to the inner combustion chamber wall.

* * * * *